US007735814B2

(12) United States Patent
Ben-Gigi

(10) Patent No.: US 7,735,814 B2
(45) Date of Patent: Jun. 15, 2010

(54) CLAMP WITH CLAMP FORCE SENSOR

(75) Inventor: Zion Ben-Gigi, Kfar Veradim (IL)

(73) Assignee: Tefentools Ltd., Tefen (IL)

( * ) Notice: Subject to any disclaimer, the term of this patent is extended or adjusted under 35 U.S.C. 154(b) by 823 days.

(21) Appl. No.: 11/569,875

(22) PCT Filed: May 30, 2005

(86) PCT No.: PCT/IL2005/000552

§ 371 (c)(1),
(2), (4) Date: Dec. 1, 2006

(87) PCT Pub. No.: WO2005/118224

PCT Pub. Date: Dec. 15, 2005

(65) Prior Publication Data

US 2009/0194924 A1 Aug. 6, 2009

(30) Foreign Application Priority Data

Jun. 1, 2004 (IL) ..... 162291

(51) Int. Cl.
*B25B 5/06* (2006.01)
*B25B 5/16* (2006.01)

(52) U.S. Cl. ..... 269/165; 269/3; 269/6

(58) Field of Classification Search ..... 269/165, 269/166, 6, 3
See application file for complete search history.

(56) References Cited

U.S. PATENT DOCUMENTS

| | | | | |
|---|---|---|---|---|
| 4,059,991 | A | 11/1977 | Dybel et al. | |
| 5,129,350 | A | 7/1992 | Marelin | |
| 5,337,488 | A * | 8/1994 | Lemelson | 33/784 |
| 5,467,656 | A * | 11/1995 | Teare et al. | 73/862.541 |
| 5,501,107 | A * | 3/1996 | Snyder et al. | 73/862.23 |
| 5,649,934 | A * | 7/1997 | Smeltzer et al. | 606/122 |
| 5,666,964 | A * | 9/1997 | Meilus | 600/557 |
| 6,758,098 | B1 * | 7/2004 | Nunnelee | 73/760 |
| 2009/0194924 | A1 * | 8/2009 | Ben-Gigi | 269/165 |

FOREIGN PATENT DOCUMENTS

| | | |
|---|---|---|
| DE | 3439004 | 4/1986 |
| DE | 3825680 | 2/1990 |
| DE | 29806179 | 10/1998 |

* cited by examiner

*Primary Examiner*—Lee D Wilson
(74) *Attorney, Agent, or Firm*—Dekel Patent Ltd.; David Klein

(57) ABSTRACT

A clamp including at least one clamping element (e.g., clamping jaw, clamping strap, etc.) and a hand-operated actuator operative to move the clamping element in a clamping direction, and a clamping force sensor in operative connection with the clamping element.

6 Claims, 5 Drawing Sheets

CLAMP WITH CLAMP FORCE SENSOR

FIELD OF THE INVENTION

The present invention relates generally to clamps for clamping workpieces and the like, and particularly to a clamp with a clamping force sensor.

BACKGROUND OF THE INVENTION

There are many kinds of clamps used to grip objects. One kind of clamp, often referred to as a spring clamp, is provided with a spring that forces the jaws of the clamp towards one another. In order to use a spring clamp, one squeezes the handles of the clamp together, wherein the squeezing action works against the force of the spring, thereby spreading the clamp jaws apart and permitting insertion of a workpiece or workpieces between the jaws. Upon release of the squeezing force, the spring forces the jaws against the workpiece or workpieces.

A variation of the spring clamp is known as an adjustable clamp. In an adjustable clamp, a spring is provided that forces the jaws of the clamp away from one another. When a user squeezes the handles of the adjustable clamp towards one another, the clamp jaws are gradually brought closer to one another until they finally abut each other. A ratchet mechanism is provided that works against the force of the spring and arrests the clamping jaws at discrete positions as they approach one another. The ratchet mechanism thus permits adjusting and maintaining the clamping jaws at any desired position as the handles of the adjustable clamp are squeezed together. In this manner, the jaws may be clamped against a workpiece or workpieces placed between the jaws.

Bar clamps generally comprise a pair of clamping jaws that slide along a bar. A workpiece may be clamped between the jaws by abutting the jaws against opposite sides of the workpiece, and then tightening the jaws against the workpiece, such as by repetitive squeezing of a hand-held trigger mechanism.

The bar clamp may also be used to spread objects apart. This may be accomplished in some bar clamps by turning around the clamping jaws 180°, which reverses the advancing movement of the jaws along the bar towards each other into a retreating movement away from each other. The objects may be spread apart by abutting the jaws against the appropriate surfaces of the objects, and then moving the jaws in the spreading direction, such as by repetitive squeezing of the hand-held trigger mechanism.

SUMMARY OF THE INVENTION

The present invention seeks to provide an improved clamp with a clamping force sensor, as described more in detail hereinbelow.

There is thus provided in accordance with an embodiment of the present invention a clamp including at least one clamping element (e.g., clamping jaw, clamping strap, etc.) and a hand-operated actuator operative to move the clamping element in a clamping direction, and a clamping force sensor in operative connection with the clamping element. The clamping force sensor may be in operative connection with a clamping force indicator, which may be mounted on the clamp or in remote communication with the clamp force sensor.

BRIEF DESCRIPTION OF THE DRAWINGS

The present invention will be understood and appreciated more fully from the following detailed description taken in conjunction with the drawings in which.

DETAILED DESCRIPTION OF EMBODIMENTS

Figure 1:
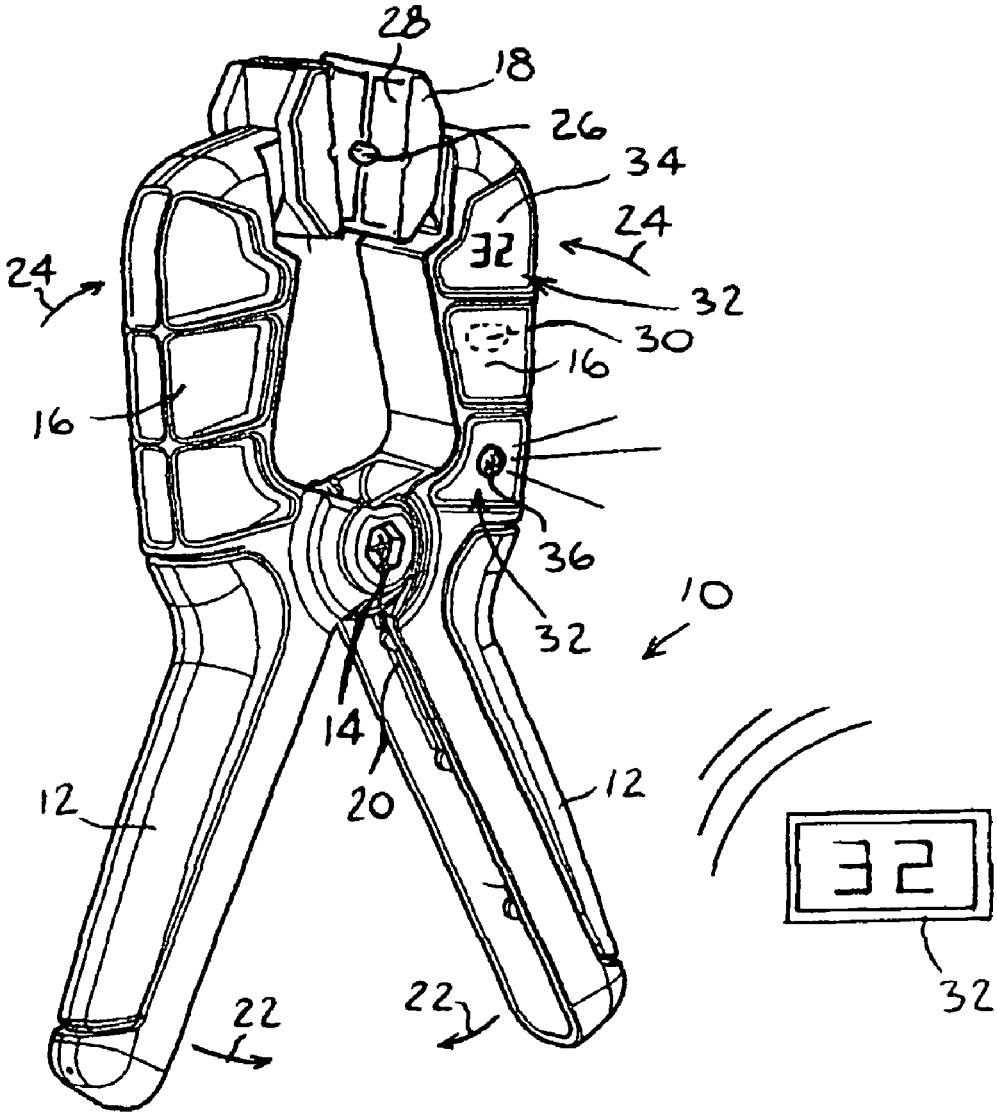
FIGS. 1-3 are simplified pictorial illustrations of clamps, constructed and operative in accordance with embodiments of the present invention, the clamps respectively being a spring clamp, an adjustable clamp and a bar clamp.

Reference is now made to FIG. 1, which illustrates a clamp 10, constructed and operative in accordance with an embodiment of the present invention.

Clamp 10 may include a pair of handles 12 that are pivoted about a pivot 14. A pair of clamping arms 16 may extend from handles 12. Each clamping arm 16 may include a clamping jaw 18 attached thereto. The clamping jaw 18 is also referred to as a clamping element. Clamping jaw 18 may be pivotally attached to clamping arm 16. A spring 20 may be mounted in juxtaposition with pivot 14. Clamp 10 is a spring clamp. In operation, one squeezes the handles 12 together in the direction of arrows 22, working against the force of spring 20, thereby spreading the clamping jaws 18 apart and permitting insertion of a workpiece (not shown) between clamping jaws 18. Upon release of the squeezing force, spring 20 forces clamping jaws 18 against the workpiece in the direction of arrows 24. The spring 20 and handles 12 thus comprise a hand-operated actuator capable of moving clamping jaws 18 in a clamping direction.

In accordance with an embodiment of the present invention, a clamping force sensor 26 is in operative connection with one or more clamping jaws 18. For example, the clamping force sensor 26 may be disposed on a clamping face 28 of one or both clamping jaws 18. The clamping force sensor 26 may be flush with the clamping face 28 or may protrude therefrom, for example. The clamping force sensor 26 may be any kind of sensor suitable for sensing a force or pressure, such as but not limited to, a load cell, a pressure sensor, an accelerometer, a strain gauge or any combination thereof. Such sensors are readily available in miniature sizes and larger sizes measuring a vast range of forces, and are commercially available from such manufacturers as Honeywell Sensotech and Entran Devices. A power source 30, such as a battery, may be disposed in clamp 10 for powering clamping force sensor 26. The clamping force sensor 26 does not necessarily have to be electrically powered, and may be, without limitation, mechanical, hydraulic, pneumatic or any combination thereof.

The clamping force sensor 26 may be in operative (e.g., electrically wired) connection with a clamping force indicator 32. The clamping force indicator 32 may be mounted on any portion of clamp 10. Alternatively or additionally, clamping force indicator 32 may be in remote communication with clamp force sensor 26, such as by RF, IR or BLUETOOTH communication. Clamping force indicator 32 may comprise, without limitation, a visual indicator 34 (e.g., a digital output indicator), or an audible indicator 36 (e.g., a speaker with a voice chip).

Figure 2:
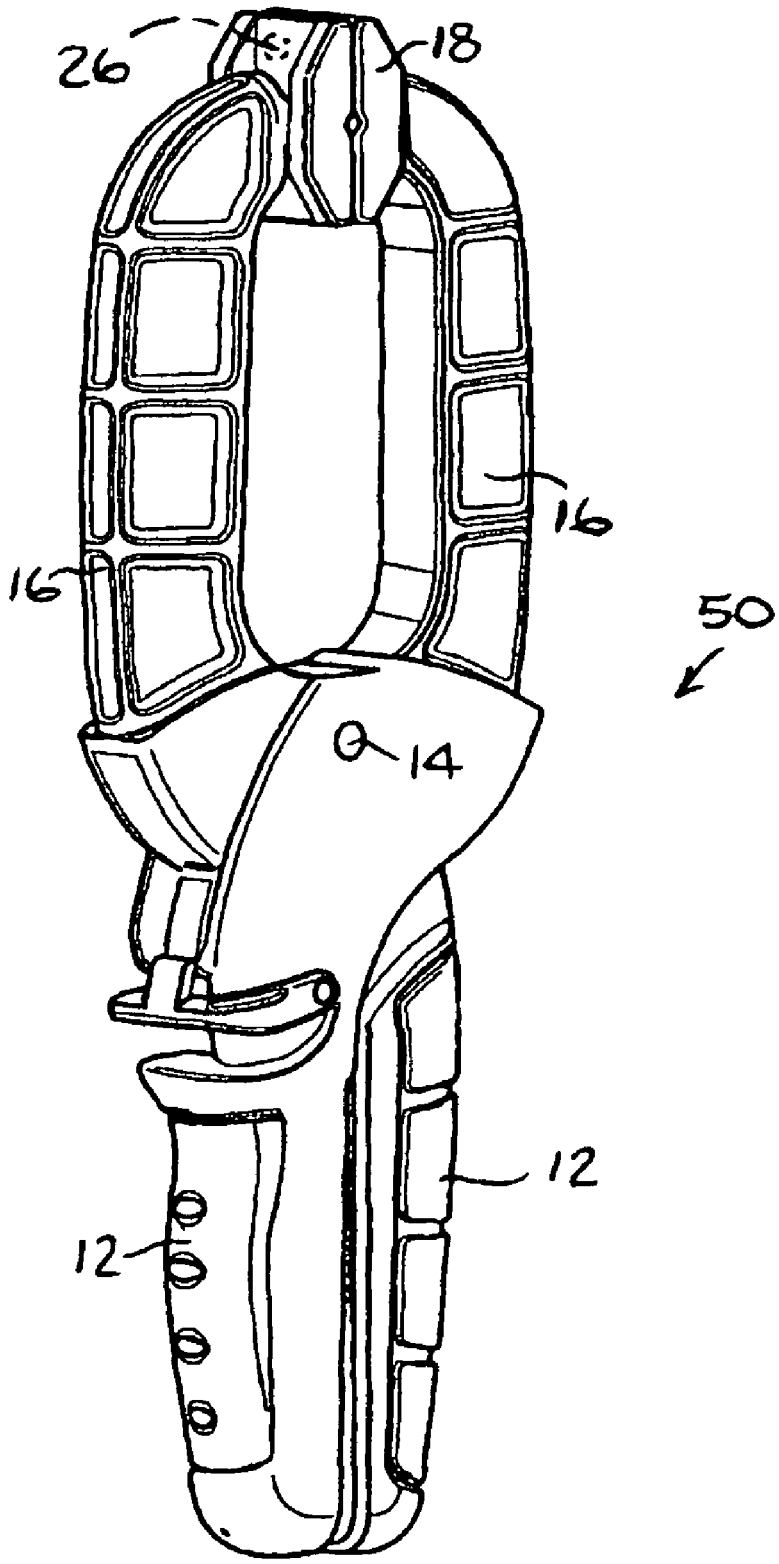
Figure 3:
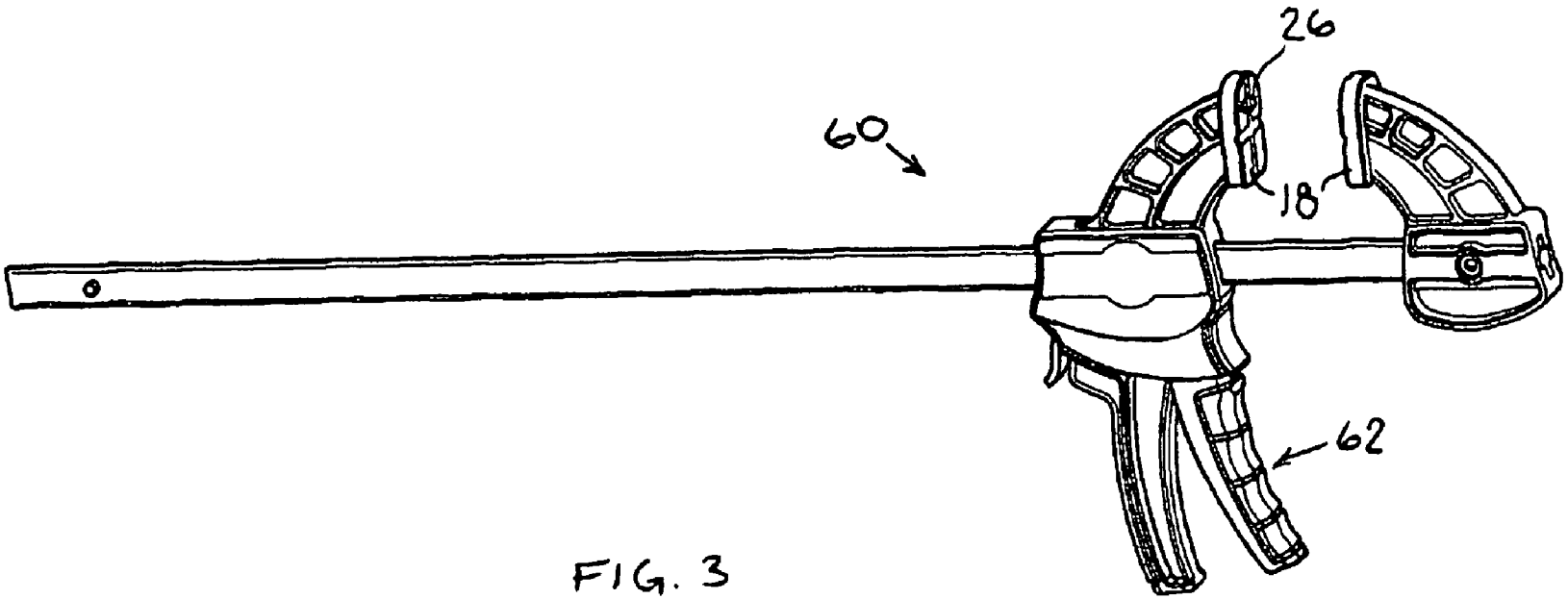

The clamp 10 of FIG. 1 is a spring clamp. Reference is now made to FIGS. 2 and 3, which illustrate other types of clamps, constructed and operative in accordance with embodiments of the present invention, the clamps respectively being an adjustable clamp 50 and a bar clamp 60. As mentioned previously, and as is well known in the art, an adjustable clamp has a spring that forces the clamping jaws away from one another. A ratchet mechanism is provided that works against the force of the spring and arrests the clamping jaws at discrete positions as they approach one another. The bar clamp may comprise a pair of clamping jaws that slide along a bar. Here a hand-held trigger mechanism 62 is the hand-operated actuator that moves clamping jaws 18 in a clamping direction. These are just examples of clamps and the invention is not limited to these clamps.

Figure 4:
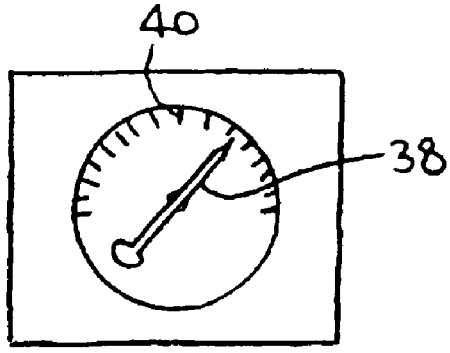
FIGS. 4-7 are simplified pictorial illustrations of different clamping force indicators, constructed and operative in accordance with different embodiments of the present invention, wherein in FIG. 4, the clamping force indicator includes a pointing needle that moves with respect to graduations, in FIG. 5, the clamping force indicator includes a variable color indicator, and in FIGS. 6 and 7, the clamping force indicator includes a displayed graphic object (e.g., a face of a cartoon character) that changes as a function of the clamping force sensed by clamping force sensor.
Figure 5:
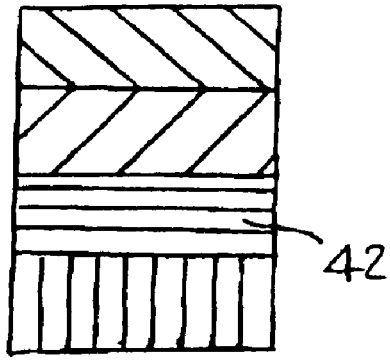
Figure 6:
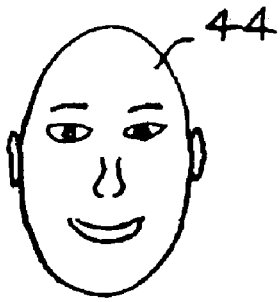
Figure 7:
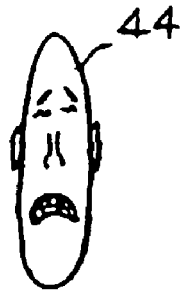

Reference is now made to FIGS. 4-7, which illustrate different embodiments of clamping force indicator 32. For example, clamping force indicator 32 may comprise a pointing needle 38 that moves with respect to graduations 40, as seen in FIG. 4. In another example, clamping force indicator 32 may comprise a variable color indicator 42, such as an LED or LCD color display, wherein a bar graph increases with increasing clamping force (and conversely decreases with decreasing clamping force) and may also change color in accordance with the clamping force, as seen in FIG. 5. In yet another example, as seen in FIGS. 6 and 7, clamping force indicator 32 may comprise a displayed graphic object 44 (e.g., a face of a cartoon character) that changes as a function of the clamping force sensed by clamping force sensor 26. The graphic object 44 may be displayed on a LED or LCD (color or black-and-white) display and may be controlled by a microprocessor (not shown) that transforms the sensed force into a set of graphics. In FIG. 6, the clamping force is not great and the face shows little or no emotion. In FIG. 7, the clamping force has increased to the point where the face "hurts" and is grimacing. Such an embodiment may be used as a toy or novelty item as well.

Figure 8:
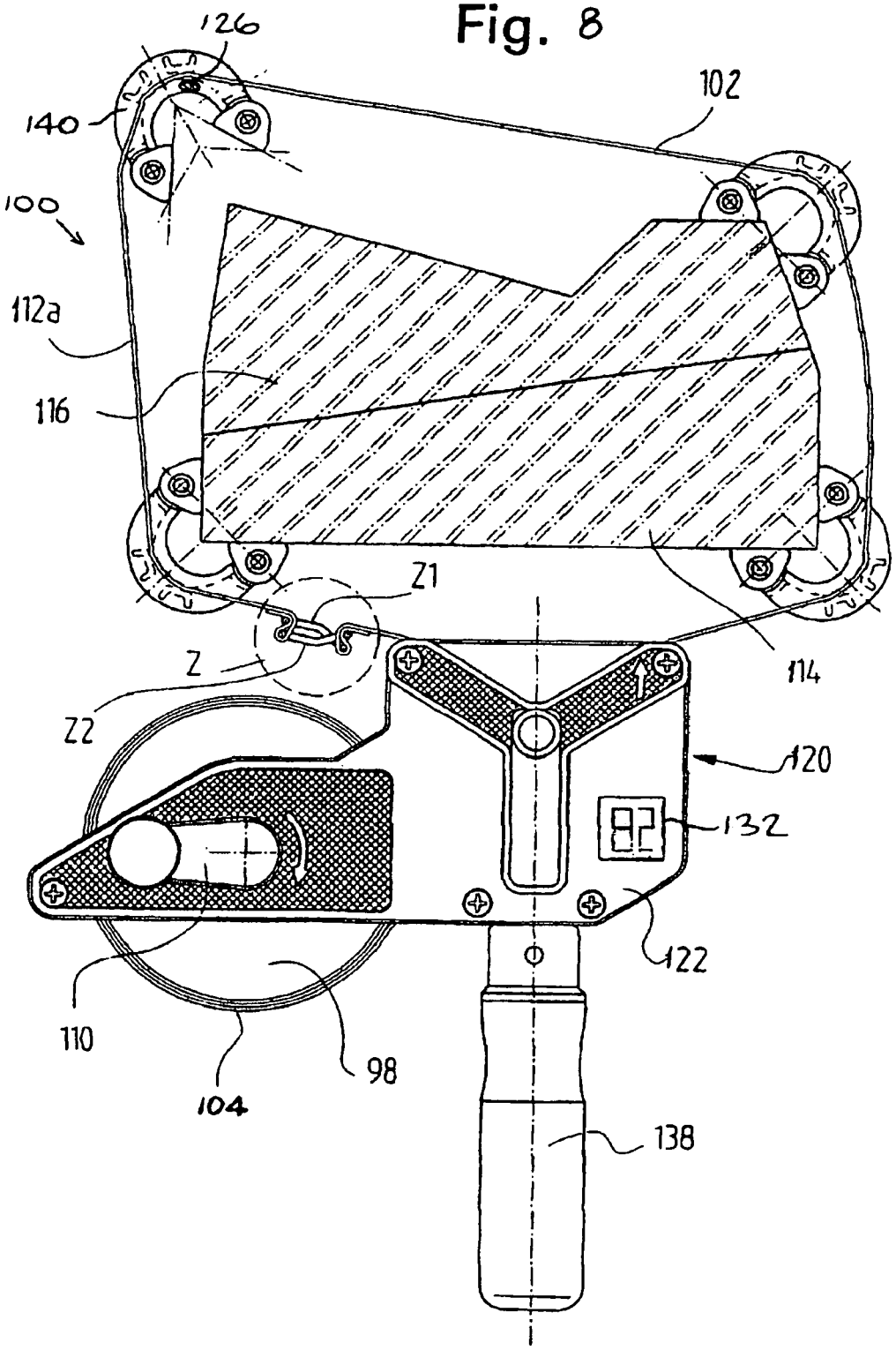
FIG. 8 is a simplified pictorial illustration of a strap clamp, constructed and operative in accordance with an embodiment of the present invention.

Reference is now made to FIG. 8, which illustrates a strap clamp 100, constructed and operative in accordance with an embodiment of the present invention.

The illustrated strap clamp (also called a band clamp, the terms being used interchangeably throughout) may be constructed like the strap clamp of U.S. Pat. No. 5,918,866 to Klimach. This strap clamp is merely illustrated for the purposes of simplicity, but it is understood that the present invention is not at all limited by the particular construction of the strap clamp of U.S. Pat. No. 5,918,866, and the present invention covers any kind of strap clamp.

Briefly, the illustrated strap clamp 100 includes an outer loop 112*a* which is formed by a clamping strap 102, preferably a textile strap. The clamping strap 102 is also referred to as a clamping element. The loop 112*a* winds around the outside of, for example, two workpieces 114 and 116 and leads to a tightening device 120, housed in a housing 122 and provided with a handle 138, which serves to tighten the outer loop 112*a*.

The outer loop 112*a* may be provided with a lock Z with lock elements Z1 and Z2 which are connectable to and releasable from each other. The lock Z makes it possible to open the outer loop 112*a* to enable it to be placed around the workpieces 114 and 16 without these having to be pushed through the loop from a position alongside it.

Coils 104 of clamping strap 102 may be wound about a spool 98 with a crank handle 110. The tightening device 120 is thus a hand-operated actuator operative to move the clamping element in a clamping direction.

In accordance with an embodiment of the present invention, strap clamp 100 includes a clamping force sensor 126 in operative connection with the clamping element, clamping strap 102. For example, the clamping force sensor 126 may be disposed on a sprocket 140 (or in the vicinity thereof) around which the clamping strap 102 is wound, or on the clamping strap 102 itself. As described hereinabove, clamping force sensor 126 may be any kind of sensor suitable for sensing a force or pressure, such as but not limited to, a load cell, a pressure sensor, an accelerometer, a strain gauge or any combination thereof. The clamping force sensor 126 may be in operative (e.g., electrically wired) connection with a clamping force indicator 132. Clamping force indicator 132 may be as described hereinabove, and may be mounted on any portion of strap clamp 100 or may be remote thereto.

It is noted that the clamping force sensors and clamping force indicators of the invention may be assembled by the clamp manufacturer on to the clamp and provided therewith for sale. Alternatively, the clamping force sensors and clamping force indicators of the invention may be provided as an add-on kit, wherein the end user purchases the kit and assembles it to a particular clamp.

It is appreciated that various features of the invention which are, for clarity, described in the contexts of separate embodiments, may also be provided in combination in a single embodiment. Conversely, various features of the invention which are, for brevity, described in the context of a single embodiment, may also be provided separately or in any suitable subcombination.

What is claimed is:

1. A bar clamp comprising:

a pair of clamping jaws mounted along a bar, and a hand-operated trigger mechanism adapted to cause relative motion between said clamping jaws in a clamping direction along said bar, each of said clamping jaws have a clamping face arranged to face and press against a work piece;

a clamping force sensor mounted flush on the clamping face of at least one of said clamping jaws;

a battery disposed on said bar clamp and in operative connection with said clamping force sensor; and a clamping force indicator disposed on said bar clamp and in operative connection with said clamping force sensor for indicating a clamping force as sensed by said clamping force sensor, wherein said clamping force indicator comprises an audible indicator.

2. The clamp according to claim 1, wherein said clamping force sensor comprises at least one of a load cell, a pressure sensor, an accelerometer, and a strain gauge.

3. The clamp according to claim 1, wherein said clamping force indicator comprises a visual indicator.

4. The clamp according to claim 3, wherein said clamping force indicator comprises a variable color indicator.

5. The clamp according to claim 3, wherein said clamping force indicator comprises a displayed graphic object that changes as a function of a clamping force sensed by said clamping force sensor.

6. A bar clamp comprising:

a pair of clamping jaws mounted along a bar, and a hand-operated trigger mechanism adapted to cause relative motion between said clamping jaws in a clamping direction along said bar, each of said clamping jaws have a clamping face arranged to face and press against a work piece;

a clamping force sensor mounted flush on the clamping face of at least one of said clamping jaws;

a battery disposed on said bar clamp and in operative connection with said clamping force sensor; and a clamping force indicator disposed on said bar clamp and in operative connection with said clamping force sensor for indicating a clamping force as sensed by said clamping force sensor, wherein said clamping force indicator comprises a visual indicator, and wherein said clamping force indicator comprises a displayed graphic object that changes as a function of a clamping force sensed by said clamping force sensor, and wherein said displayed graphic object comprises a character with a face, wherein when the clamping force is not great the face is not contorted, and when the clamping force increases the face grimaces.

* * * * *